US006737798B2

(12) United States Patent
Ha

(10) Patent No.: US 6,737,798 B2
(45) Date of Patent: May 18, 2004

(54) BUILT-IN CHIP VACUUM FLUORESCENT DISPLAY

(75) Inventor: Sung-Ho Ha, Pusan (KR)

(73) Assignee: Samsung SDI Co., Ltd., Suwon (KR)

( * ) Notice: Subject to any disclaimer, the term of this patent is extended or adjusted under 35 U.S.C. 154(b) by 134 days.

(21) Appl. No.: 10/107,875

(22) Filed: Mar. 25, 2002

(65) Prior Publication Data

US 2003/0030366 A1 Feb. 13, 2003

(30) Foreign Application Priority Data

Aug. 10, 2001 (KR) ..... 2001-48309

(51) Int. Cl.[7] ..... H01J 1/62
(52) U.S. Cl. ..... 313/495; 313/496; 313/483
(58) Field of Search ..... 313/495–497, 313/483, 422

(56) References Cited

U.S. PATENT DOCUMENTS 4,164,683 A * 8/1979 Nakamura et al. ..... 313/496
4,540,983 A * 9/1985 Morimoto et al. ..... 345/75.1
5,150,005 A * 9/1992 Yokono ..... 313/495
5,270,613 A * 12/1993 Kim ..... 313/496
5,465,027 A * 11/1995 Ishizuka et al. ..... 313/517
5,736,814 A * 4/1998 Kinoshita et al. ..... 313/495
5,739,634 A * 4/1998 Kinoshita et al. ..... 313/496
6,525,485 B2 * 2/2003 Kasano et al. ..... 315/169.4

* cited by examiner

*Primary Examiner*—Ashok Patel
*Assistant Examiner*—German Colón
(74) *Attorney, Agent, or Firm*—Christie, Parker & Hale, LLP

(57) ABSTRACT

A built-in chip vacuum fluorescent display including a vacuum tube having a transparent top substrate, a bottom substrate facing the top substrate with driver chip wirings while being spaced apart from the top substrate with a predetermined distance, and a side glass disposed between the top and the bottom substrates while interconnecting the top and the bottom substrates. A plurality of driver chips are mounted at the bottom substrate within the vacuum tube while being electrically connected to the driver chip wirings. At least one subsidiary substrate is provided at the space between the top and the bottom substrates within the vacuum tube while having wirings electrically connected to the driver chip wirings. Cathodes are provided between the subsidiary substrate and the top substrate within the vacuum tube to emit thermal electrons. Phosphors are patterned at the subsidiary substrate while being electrically connected to the wirings.

11 Claims, 1 Drawing Sheet

BUILT-IN CHIP VACUUM FLUORESCENT DISPLAY

GROSS-REFERENCE TO RELATED APPLICATION

This application claims priority of Korean Application No. 2001-48309, fried on Aug. 10, 2001 in the Korean Patent Office the entire disclosures of which is incorporated herein by reference.

FIELD OF THE INVENTION

The present invention relates to a vacuum fluorescent display and, more particularly, to a built-in chip vacuum fluorescent display which is mounted with driver chips within a vacuum tube.

BACKGROUND OF THE INVENTION

Generally, vacuum fluorescent displays (VFDs) may be classified into various formats depending upon the structure, the display area, the display content, and the manner of driving. Particularly in view of the display area, the VFDs can be classified into a usual type, a front luminescent type, and a dual layer type. In view of the display content, the VFDs can be classified into a number display type, a character display type, and a graphic display type.

The graphic display type VFD has phosphors patterned in a dot matrix type corresponding to the picture signal information, and driver chips for selectively driving the grid electrodes. For example, assume that the graphic display type VFD with a dot matrix of 128×128 is driven in a fourfold or eightfold manner. When only the phosphors (the anode electrodes) are driven while omitting the drivers for driving the grids, the number of anode electrodes interconnected via the same wiring line amounts to 512 with the fourfold driving manner, and to 1024 with the eightfold driving manner. Accordingly, even with the use of a 128 bit driver, four driver chips should be provided with the fourfold drive type VFD, and eight driver chips with the eightfold drive type VFD.

The driver chips are mounted on a glass placed at the inside or outside of a vacuum tube outlining the VFD by way of a mounting technique called chip on glass (COG) or chip in glass (CIG). For example, such a structure is disclosed in U.S. Pat. No. 5,739,634.

When the mounting of the driver chips is made by way of the COG or CIG technique, the driver chips, the phosphors and the anode electrodes are provided at the same substrate. Therefore, it becomes necessary for an additional space for mounting the driver chips to be provided as compared to the VFD wherein the driver chips are not mounted within the vacuum tube. For this reason, the size of the vacuum tube becomes needlessly enlarged to accommodate the increase in area unnecessary for the display purposes.

Such a problem becomes serious in the graphic display type VFD mounted with large numbers of driver chips within the limited effective area.

In the case of a graphic display type VFD with a dot matrix of 128×128, when four or eight driver chips are mounted in accordance with the CIG technique, the non-effective area for mounting the driver chips at the inside of the vacuum tube is at best in the range of 15~25 mm from the periphery of the effective area. Consequently, as the area for mounting the driver chips is extremely limited, it becomes difficult to design the structure of the VFD in a suitable manner.

SUMMARY OF THE INVENTION

In accordance with the present invention a built-in chip vacuum fluorescent display is provided which can be effectively mounted with a plurality of driver chips within a vacuum tube.

According to one aspect of the present invention, the built-in chip vacuum fluorescent display includes a vacuum tube having a transparent top substrate, a bottom substrate facing the top substrate with driver chip wirings while being spaced apart from the top substrate with a predetermined distance, and a side glass disposed between the top and the bottom substrates while interconnecting the top and the bottom substrates. A plurality of driver chips are mounted at the bottom substrate within the vacuum tube while being electrically connected to the driver chip wirings. At least one subsidiary substrate is provided at the space between the top and the bottom substrates within the vacuum tube while having wirings electrically connected to the driver chip wirings. Cathodes are provided between the subsidiary substrate and the top substrate within the vacuum tube to emit thermal electrons. Anodes with phosphors are patterned at the subsidiary substrate while being electrically connected to the wirings.

According to another aspect of the present invention, the built-in chip vacuum fluorescent display includes a vacuum tube having a transparent top substrate with first wirings, a bottom substrate facing the top substrate with driver chip wirings while being spaced apart from the top substrate with a predetermined distance, and a side glass disposed between the top and the bottom substrates while interconnecting the top and the bottom substrates. A plurality of driver chips are mounted at the bottom substrate within the vacuum tube while being electrically connected to the driver chip wirings. At least one subsidiary substrate is provided at the space between the top and the bottom substrates within the vacuum tube while having second wirings electrically connected to the driver chip wirings. Cathodes are provided between the subsidiary substrate and the top substrate within the vacuum tube to emit thermal electrons. First anodes with phosphors are patterned at the top substrate while being electrically connected to the first wirings. Second anodes with phosphors are patterned at the subsidiary substrate while being electrically connected to the second wirings.

According to still another aspect of the present invention, the built-in chip vacuum fluorescent display includes a vacuum tube having a pair of main substrates facing each other while being spaced apart from each other with a predetermined distance, and a side glass disposed between the main substrates while interconnecting the main substrates. A subsidiary substrate is provided between the main substrates. Anodes are patterned at the subsidiary substrates with phosphors. The phosphors emit light upon landing of thermal electrons emitted from cathodes. A grid controls the thermal electrons landing on the phosphors. A plurality of driver chips are mounted at one of the main substrates within the vacuum tube to selectively drive either the anode or the anode and the grid.

The driver chip wirings and the wirings are electrically connected to each other by way of bonding wires.

The driver chips have output terminals electrically connected to the driver chip wirings by way of bonding wires.

The phosphors are patterned in a dot matrix type for display graphic images.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE INVENTION

Figure 1:
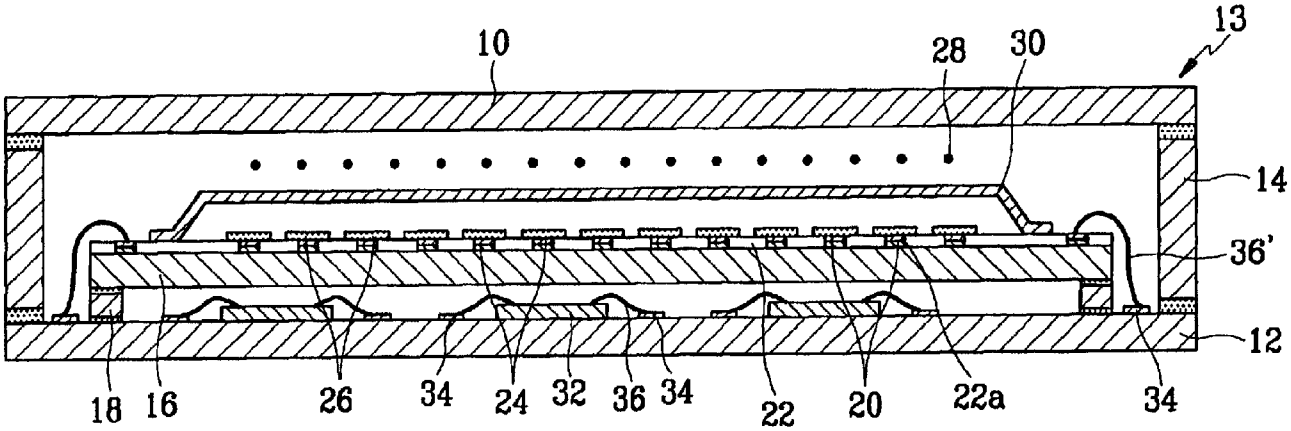
FIG. 1 is a cross sectional view of a built-in chip vacuum fluorescent display according to a first embodiment of the present invention.

FIG. 1 is a cross sectional view of a built-in chip vacuum fluorescent display according to a first embodiment of the present invention.

As shown in FIG. 1, the built-in chip vacuum fluorescent display includes transparent top substrate 10, bottom substrate 12 facing top substrate 10 while being spaced apart from each other, and side glass 14 disposed between substrates 10 and 12 while interconnecting them to thereby form vacuum tube 13.

Top and bottom substrates 10 and 12 become main substrates for forming vacuum tube 13. In vacuum tube 13, at least one subsidiary substrate 16 is placed over bottom substrate 12 with a size smaller than that of top and bottom substrates 10 and 12 while being supported by thin glass plate-based spacer 18. Subsidiary substrate 16 is spaced apart from bottom substrate 12 with a distance of 1~3 mm.

A predetermined pattern of anode wirings 20 is formed on subsidiary substrate 16 together with insulating layer 22 for preventing needless communication between anode wirings 20.

Phosphors 26 are formed on insulating layer 22 while being patterned in a dot matrix type in correspondence with the pattern of anode wirings 20. Phosphors 26 are arranged within through-holes 22*a* of insulating layer 22 such that they form anodes for the vacuum fluorescent display together with dot layer 24 electrically interconnecting anode wirings 20 and phosphors 26.

Carbonate-coated filaments 28 for cathodes are mounted between phosphors 26 and top substrate 10 while being supported by supports (not shown). Furthermore, mesh grid 30 is provided between phosphors 26 and filaments 28 to control the thermal electrons emitted from filaments 28.

The supports for supporting filaments 28 may be fixed to any one of subsidiary substrate 16 and bottom substrate 12. It is preferable that mesh grid 30 be fixed to the top of subsidiary substrate 16.

A plurality of driver chips 32 are provided on bottom substrate 12 within vacuum tube 13 to selectively drive either phosphors 26 or phosphors 26 and mesh grid 30 in correspondence with the picture signal information.

Driver chips 32 are provided with input and output terminals (not shown) electrically connected to driver chip wirings 34 provided on bottom substrate 12 to receive the required driving voltages from the outside of vacuum tube 13. The electrical connection of driver chips 32 to driver chip wirings 34 is made by way of bonding wires 36.

Anode wirings 20 are also electrically connected to driver chip wirings 34 such that the electrical signals due to the driving of driver chips 32 are substantially applied to phosphors 26 via dot layer 24. The electrical connection of anode wirings 20 to driver chip wirings 34 is also made by way of bonding wires 36'.

The electrical connection of driver chips 32 to driver chip wirings 34 as well as the electrical connection of anode wirings 20 to driver chip wirings 34 may be made by way of metal bumps in addition to bonding wires 36 and 36'.

In operation, when voltage is applied to driver chip wirings 34 via lead pins (not shown), driving signals are output from driver chips 32 via the output terminals such that either phosphors 26 or the phosphors and mesh grid 30 are selectively driven in correspondence with the picture signal information. The driving signals from driver chips 32 are transmitted to either phosphors 26 or the phosphors and mesh grid 30 via bonding wires 36, driver chip wirings 34, bonding wires 36' and anode wirings 20. Consequently, phosphors 26 turn on/off to thereby display the desired graphic images.

Figure 2:
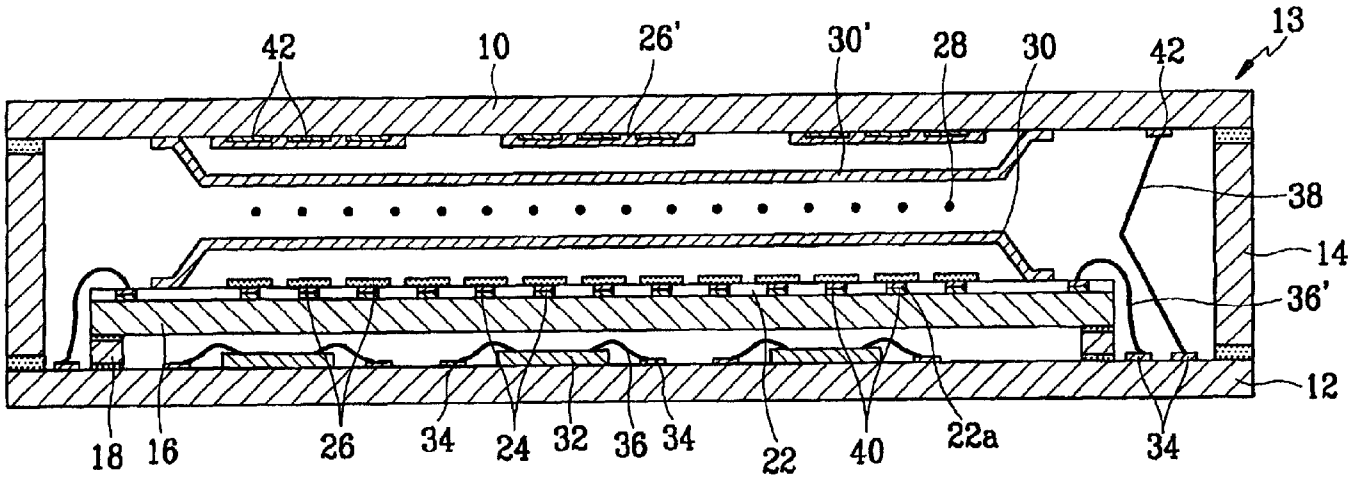
FIG. 2 is a cross sectional view of a built-in chip vacuum fluorescent display according to a second embodiment of the present invention.

FIG. 2 is a cross sectional view of a dual layer type built-in chip vacuum fluorescent display according to a second embodiment of the present invention.

In vacuum tube 13, at least one subsidiary substrate 16 is placed over bottom substrate 12 while being supported by spacer 18. Subsidiary substrate 16 is spaced apart from bottom substrate 12 with a distance of 1~3 mm. Second wirings 40, insulating layer 22, dot layer 24 and phosphors 26 of a dot matrix type are formed on subsidiary substrate 16. First wirings 42 based on aluminum Al or indium tin oxide (ITO) are formed on top substrate 10 facing subsidiary substrate 16, and phosphors 26' are formed at first wirings 42 with a predetermined pattern.

A plurality of filaments 28 for cathodes are mounted between first and second wirings 42 and 40. First mesh grid 30' is provided between first wirings 42 and filaments 28, and second mesh grid 30 is provided between second wirings 40 and filaments 28. First mesh grid 30' is standing with the side of top substrate 10, and second mesh grid 30 with the side of subsidiary substrate 16.

A plurality of driver chips 32 are provided on bottom substrate 12 within vacuum tube 13. Driver chips 32 are provided with input and output terminals (not shown) electrically connected to driver chip wirings 34 provided on bottom substrate 12 by way of bonding wires 36.

First and second wirings 42 and 40 are also electrically connected to driver chip wirings 34. In this embodiment, the electrical connection of first wirings 42 to driver chip wirings 34 is made by way of pin members 38, and the electrical connection of second wirings 40 to driver chip wirings 34 is made by way of bonding wires 36'.

In operation, when voltage is applied to driver chip wirings 34 via lead pins (not shown), driving signals are output from driver chips 32 via the output terminals such that either phosphors 26 or phosphors 26 and mesh grid 30 are selectively driven in correspondence with the picture signal information. The driving signals from driver chips 32 are transmitted to phosphors 26 or to phosphors 26 and mesh grid 30 via bonding wires 36, driver chip wirings 34, bonding wires 36' and first wirings 42. In addition, the driving signals from driver chips 32 are transmitted to phosphors 26' or to phosphors 26' and mesh grid 30' via pin members 38 and second wirings 40. Consequently, phosphors 26 and 26' turn on/off to thereby display the desired graphic images.

The above structure may be applied for use in the front luminescent type vacuum fluorescent display in addition to the usual type vacuum fluorescent display and the dual layer type vacuum fluorescent display.

In the front luminescent type vacuum fluorescent display, anodes for forming a predetermined display pattern by way of the light emission of the phosphors are formed at the inner surface of the top substrate, and driver chips for selectively driving the anodes and the grids are formed at the inner surface of the bottom substrate.

As described above, in the inventive built-in chip vacuum fluorescent display, the anodes for displaying information by way of light emission of the phosphors are formed at the subsidiary substrate or at the subsidiary substrate and the top substrate. In this way, the driver chips for driving the anodes or for driving the anodes and the grids can be mounted at the bottom substrate intercepted by the subsidiary substrate with no anodes, and hence, most internal area of the bottom substrate can be utilized as the driver chip mounting space.

In the above structure, sufficient chip mounting space is easily obtained irrespective of the number of driver chips. With the sufficient chip mounting space, the number of driver chips can be arbitrarily increased, and the signals applied to the built-in drivers of the respective driver chips can be rapidly controlled in a separate manner.

While the present invention has been described in detail with reference to the embodiments set forth herein, those skilled in the art will appreciate that various modifications and substitutions can be made thereto without departing from the spirit and scope of the present invention as set forth in the appended claims.

What is claimed is:

1. A built-in chip vacuum fluorescent display comprising:

a vacuum tube having a transparent top substrates a bottom substrate facing the transparent top substrate and having driver chip wirings and being spaced apart from the transparent top substrate with a predetermined distance, and a side glass disposed between the transparent top substrate and the bottom substrate and interconnecting the transparent top substrate and the bottom substrate;

a plurality of driver chips mounted at the bottom substrate within the vacuum tube and being electrically connected to the driver chip wirings;

at least one subsidiary substrate provided at the space between the transparent top substrate and the bottom substrate within the vacuum tube and having anode wirings electrically connected to the driver chip wirings;

anodes with phosphors patterned at the subsidiary substrate while being electrically connected to the anode wirings; and filaments for cathodes provided between the subsidiary substrate and the transparent top substrate within the vacuum tube to emit thermal electrons;

wherein the plurality of driver chips is located between the subsidiary substrate and the bottom substrate.

2. The built-in chip vacuum fluorescent display of claim 1 further comprising a mesh grid provided between the anodes and the cathodes to accelerate the thermal electrons emitted from the filaments toward the phosphors, or to intercept the thermal electrons.

3. The built-in chip vacuum fluorescent display of claim 1 wherein the driver chip wirings and the anode wirings are electrically connected to each other by way of bonding wires.

4. The built-in chip vacuum fluorescent display of claim 1 wherein the phosphors are patterned in a dot matrix type.

5. The built-in chip vacuum fluorescent display of claim 1 wherein the driver chips have output terminals electrically connected to the driver chip wirings by way of bonding wires.

6. A built-in chip vacuum fluorescent display comprising:

a vacuum tube having a transparent top substrate with first wirings, a bottom substrate facing the transparent top substrate and having driver chip wirings and being spaced apart from the transparent top substrate with a predetermined distance, and a side glass disposed between the transparent top substrate and the bottom substrate and interconnecting the transparent top substrate and the bottom substrate;

a plurality of driver chips mounted at the bottom substrate within the vacuum tube and being electrically connected to the driver chip wirings;

at least one subsidiary substrate provided at the space between the transparent top substrate and the bottom substrate within the vacuum tube and having second wirings electrically connected to the driver chip wirings;

first anodes with phosphors patterned at the transparent top substrate while being electrically connected to the first wiring;

second anodes with phosphors patterned at the subsidiary substrate while being electrically connected to the second wirings; and filaments for cathodes provided between the subsidiary substrate and the transparent top substrate within the vacuum tube to emit thermal electrons;

wherein the plurality of driver chips is located between the subsidiary substrate and the bottom substrate.

7. The built-in chip vacuum fluorescent display of claim 6 further comprising a mesh grid provided between the cathodes arid the first anodes or the second anodes to accelerate the thermal electrons emitted from the filaments toward the phosphors, or to intercept the thermal electrons.

8. The built-in chip vacuum fluorescent display of claim 6 wherein the driver chip wirings and the second wirings are electrically connected to each other by way of bonding wires.

9. The built-in chip vacuum fluorescent display of claim 6 wherein the phosphors of the second anodes are patterned in a dot matrix type.

10. The built-in chip vacuum fluorescent display of claim 6 wherein the driver chips have output terminals electrically connected to the driver chip wirings by way of bonding wires.

11. A built-in chip vacuum fluorescent display comprising:

a vacuum tube having a pair of main substrates facing each other while being spaced apart from each other with a predetermined distance, and having a side glass disposed between the main substrates and interconnecting the main substrates;

a subsidiary substrate provided between the main substrates;

anodes patterned at the subsidiary substrate with phosphors, the phosphors emitting light upon landing of thermal electrons emitted from filaments for cathodes;

a grid controlling the thermal electrons landing on the phosphors; and a plurality of driver chips mounted at one of the main substrates within the vacuum tube to selectively drive either the anode or the anode and the grid;

wherein the plurality of driver chips is located between the subsidiary substrate and the one of the main substrates.

* * * * *

UNITED STATES PATENT AND TRADEMARK OFFICE

CERTIFICATE OF CORRECTION

PATENT NO. : 6,737,798 B2
DATED : May 18, 2004
INVENTOR(S) : Sung-Ho Ha

It is certified that error appears in the above-identified patent and that said Letters Patent is hereby corrected as shown below:

Column 5,
Line 28, replace “substrates a” with -- substrate, a --

Column 6,
Line 20, replace “wiring;” with -- wirings; --
Line 31, replace “arid” with -- and --

Signed and Sealed this

Twenty-second Day of March, 2005

JON W. DUDAS
*Director of the United States Patent and Trademark Office*